United States Patent [19]

Vidal

[11] Patent Number: 4,983,076

[45] Date of Patent: Jan. 8, 1991

[54] FACINGS FOR EARTHWORKS

[76] Inventor: Henri Vidal, Neuilly-sur-Seine, France

[21] Appl. No.: 270,193

[22] Filed: Nov. 14, 1988

[30] Foreign Application Priority Data

| | | | |
|---|---|---|---|
| Nov. 13, 1987 | [GB] | United Kingdom | 8726636 |
| Feb. 1, 1988 | [GB] | United Kingdom | 8802131 |
| Apr. 29, 1988 | [GB] | United Kingdom | 8810184 |

[51] Int. Cl.[5] ..... E02D 29/02

[52] U.S. Cl. ..... 405/284; 405/258; 405/262

[58] Field of Search ..... 405/284, 285, 286, 287, 405/262, 258; 52/169.9, 235

[56] References Cited

U.S. PATENT DOCUMENTS

| | | | |
|---|---|---|---|
| 3,802,205 | 4/1974 | Dickinson . | |
| 3,905,169 | 9/1975 | Gallo | 52/235 X |
| 3,968,608 | 7/1976 | Swango | 52/235 |
| 3,990,199 | 11/1976 | Gallo | 52/235 X |
| 3,999,398 | 12/1976 | Kurose | 405/262 |
| 4,514,113 | 4/1985 | Neumann | 405/262 X |
| 4,661,023 | 4/1987 | Hilfiker . | |
| 4,689,928 | 9/1987 | Dutton et al. | 52/235 |

FOREIGN PATENT DOCUMENTS

| | | | |
|---|---|---|---|
| 733805 | 4/1943 | Fed. Rep. of Germany | 405/262 |
| 830584 | 5/1938 | France . | |
| 2243301 | 4/1975 | France . | |
| 0113421 | 7/1983 | Japan | 405/258 |
| 1324686 | 7/1973 | United Kingdom . | |
| 1459946 | 12/1976 | United Kingdom . | |
| 2026578 | 2/1980 | United Kingdom . | |
| 1563317 | 3/1980 | United Kingdom . | |
| 1601964 | 11/1981 | United Kingdom . | |

OTHER PUBLICATIONS

D. H. Lee: "Sheet Piling, Cofferdams, and Caissons", 1945, pp. 52–55, Concrete Publications Limited, London, Great Britain.

*Primary Examiner*—Dennis L. Taylor

*Attorney, Agent, or Firm*—Burns, Doane, Swecker & Mathis

[57] ABSTRACT

A facing for an earthwork comprises earth pressure bearing sections 2 adapted to be held rigidly relative to the rearwardly adjacent earth, for example by means of stabilizing elements 3 embedded in the earth, and moveable of the earth 4 resiliently permitting movement of the earth substantially perpendicularly to the plane of the facing whereby earth pressure on the facing panels is reduced by establishment of arching forces between the rigidly held sections 2.

13 Claims, 22 Drawing Sheets

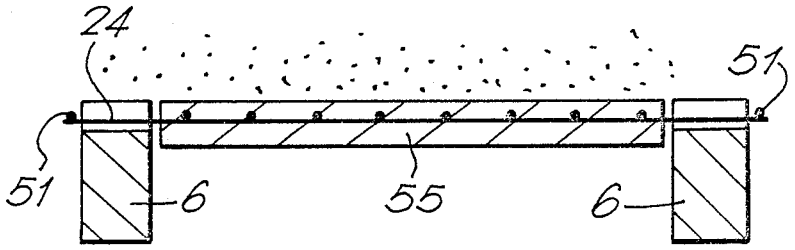
FIG. 9.
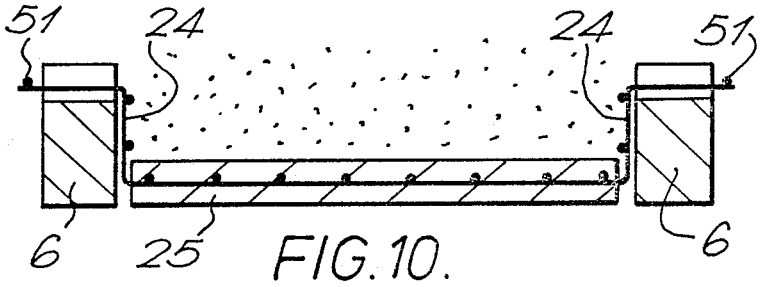
FIG. 10.
FIG. 15.
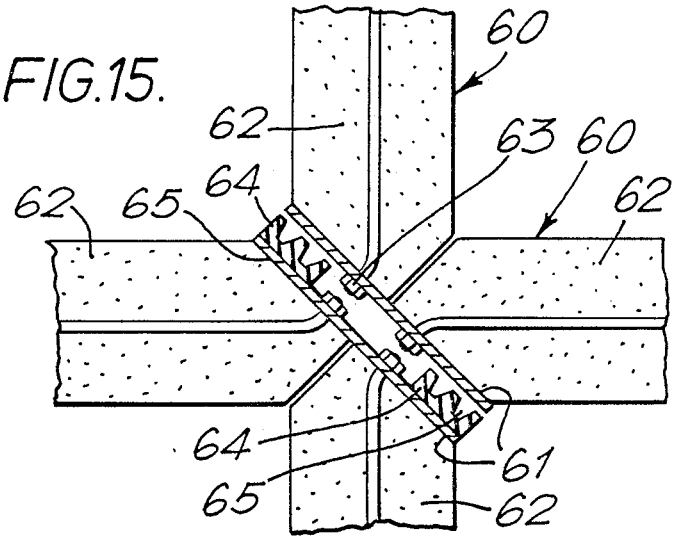

FIG.16.
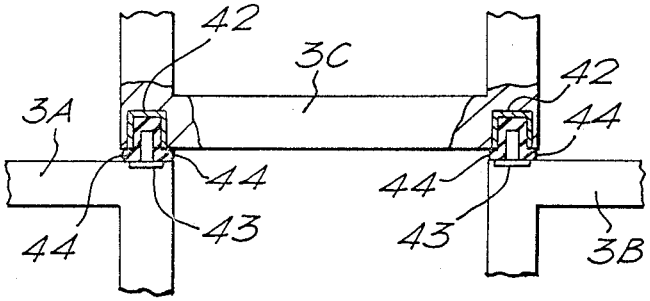
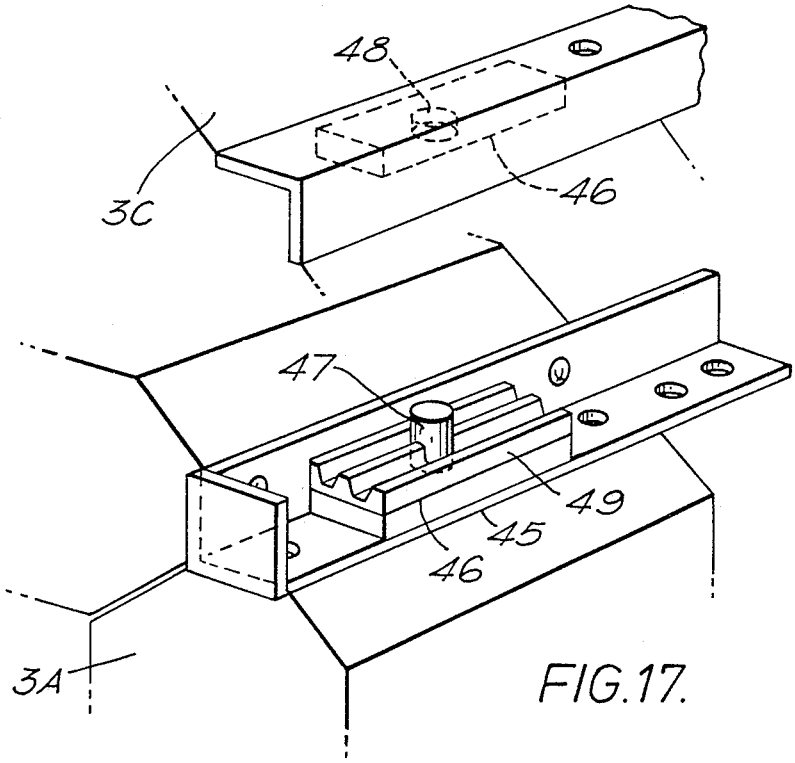
FIG.17.

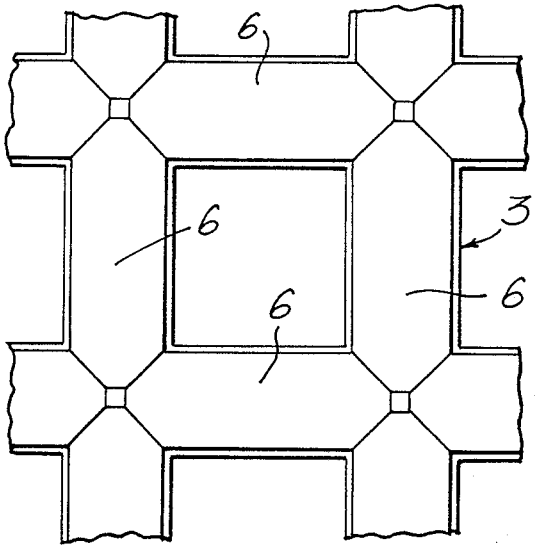
FIG. 19.
FIG. 18.
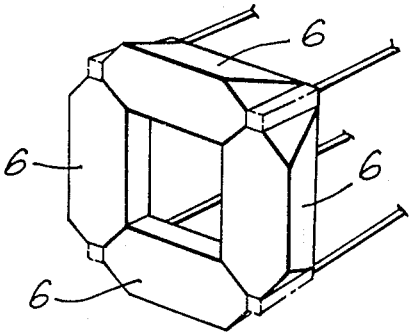
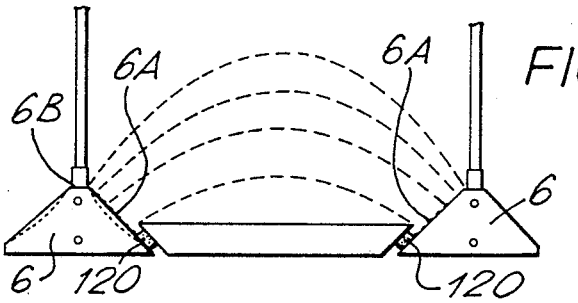
FIG. 20.

FIG. 21.
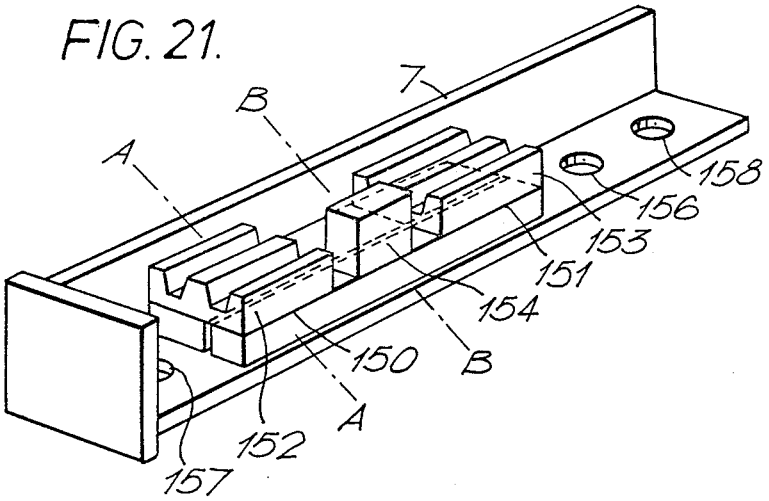
FIG. 22.
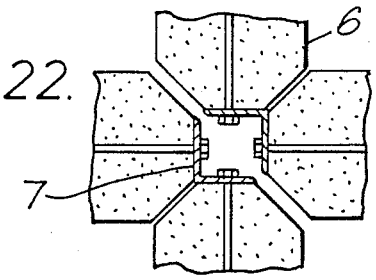
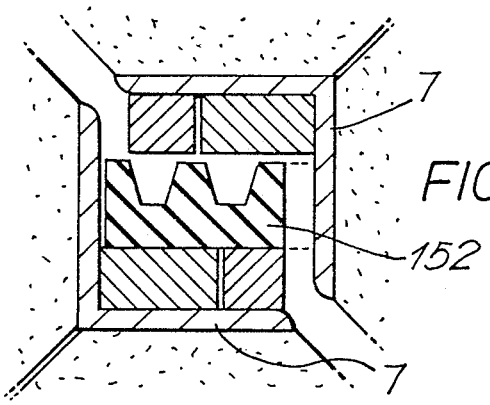
FIG. 23.

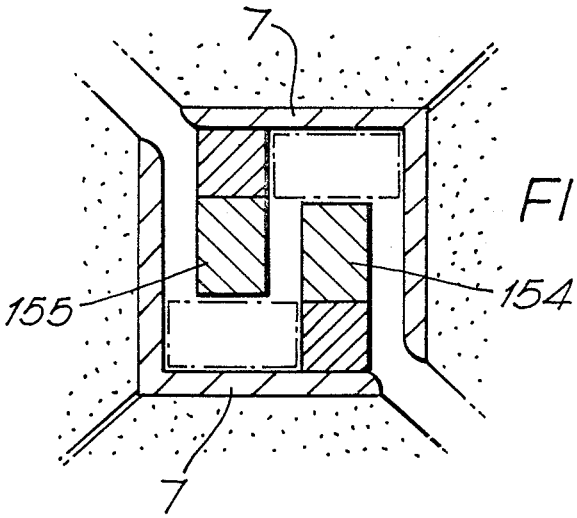
FIG. 24.
FIG. 25.
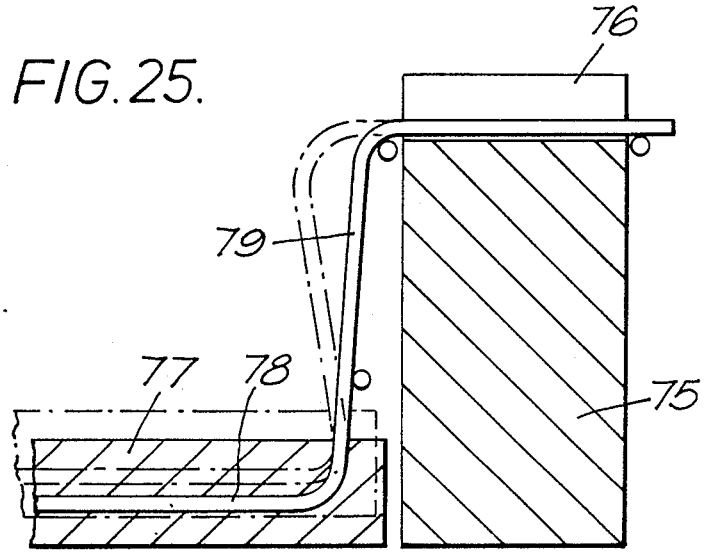

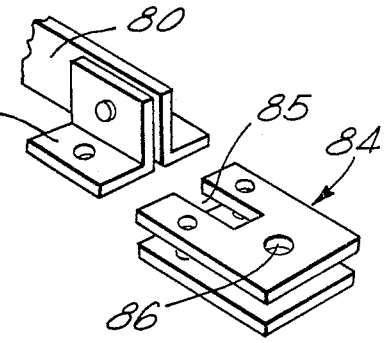
FIG. 31.
FIG. 32.
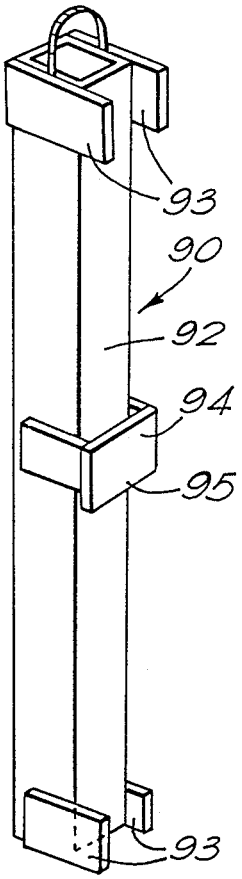
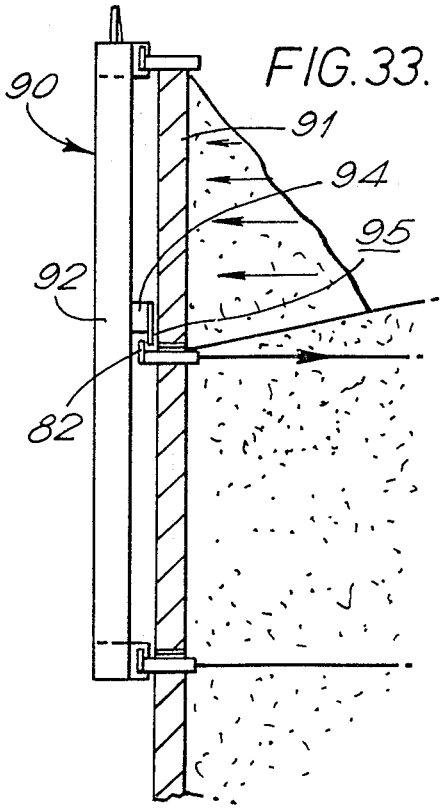
FIG. 33.

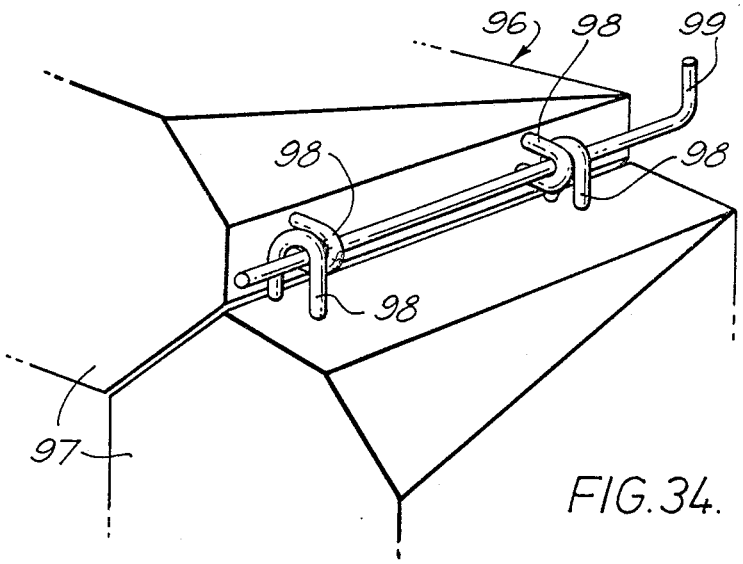
FIG. 34.
FIG. 35.
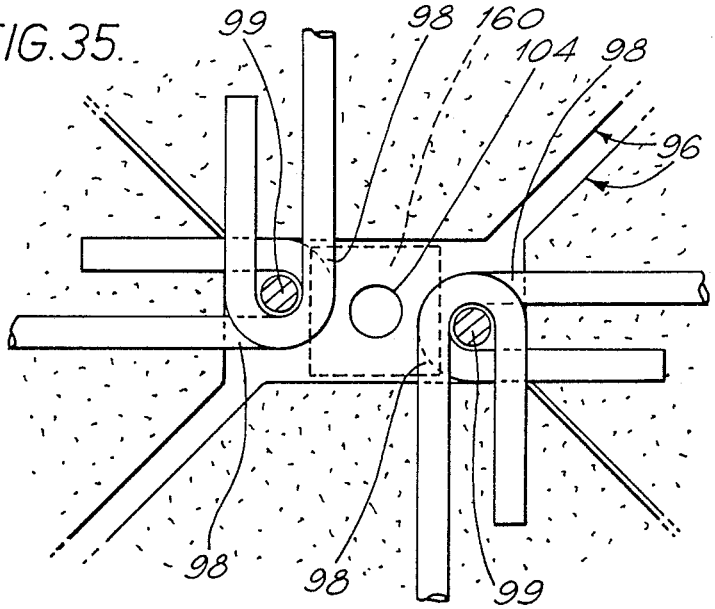

FACINGS FOR EARTHWORKS

FIELD OF THE INVENTION

This invention concerns improvements in or relating to facings and more particularly, facings for earthworks.

BACKGROUND OF THE INVENTION

Facings for earthworks are conventionally relatively thick in order to withstand earth pressures, even when the earth is stabilised, for example by inclusion of stabilising members such as reinforcement strips or grids, anchor systems or soil nails. The pressure of the earth on the facing, while often greatly reduced by interaction with stabilising members in the earth, is usually still sufficiently large to require an earth retaining facing comprising concrete panels of some 14–25cm in thickness or other panels of equivalent strength. Such panels are, however, expensive and there is a demand for a modified system using less expensive panels.

We have found that the pressure on the facing is not uniformly distributed but that the areas of the facing close to the points of attachment to stabilising members tend to carry the greater part of the pressure while at more distant locations the pressure is lower. Thus, in a system in which substantially rectangular abutting facing panels are attached to the ends of rows of embedded stabilising elements, the pressure at the centres of the units is significantly lower than that at the periphery where the stabilising members are attached.

This observation appears to be due to the phenomenon of arching within the earth mass. At the present time this phenomenon has not been fully explained and there are at least three theories of its mode of action. (Karl Terghazi, Theoretical Soil Mechanics, Whiley, p66 et seq). In principle, however, in particulate earth, compressive forces at a point are transferred by shear stresses in the earth to more distant points and the forces involved can be shown to follow an arched path within the earth mass. Where, as in the case of panels attached to stabilising members, the earth is rigidly constrained at a number of relatively close adjacent points, the arched lines of force within the earth emanating from adjacent fixed points join to form complete arches within the mass. These arches serve to retain more rearward earth and have the effect of reducing pressure at the facing at locations distant from the fixed points, e.g. at the centres of the facing panels.

Our calculations, as given in greater detail hereinafter, have shown that although arching reduces the earth pressure on the central area of a rigid panel supported between two rigidly held beams, such forces are still large even at parts on the panel at a significant distance from the rigidly held beams. In contrast, where the rigid panel is replaced by an elastic membrane the earth pressure on the elastic surface is greatly reduced even close to the rigidly held beams, although the pressure on the beams is correspondingly increased. Furthermore, the deformation of the elastic membrane is only of the order of a few millimeters, not greatly different from that of a relatively thin conventional concrete panel. In practice, however, deformations of 1–2 cm might be expected.

OBJECTS AND SUMMARY OF THE INVENTION

The present invention is based on the concept of designing the facing to take the greater part of the earth pressure in the vicinity of the points of attachment to stabilising members in the earth mass and, in order to reduce pressure at other points, to provide surfaces of the facing capable of resilient outward movement substantially perpendicular to the plane of the facing. In this way it is possible to design facing systems in which substantial areas are at reduced pressure and may thus be thinner and hence less costly, so reducing the overall cost of the facing system.

According to the present invention therefore we provide a facing for an earthwork comprising earth pressure bearing sections adapted to be held rigidly relative to earth and moveable sections resiliently permitting movement of rearwardly adjacent earth substantially perpendicularly to the plane of the facing whereby earth pressure on those elements is reduced by establishment of arching forces between said rigidly held sections.

According to a further aspect of the invention we provide an earthwork including a facing comprising earth pressure bearing sections adapted to be held rigidly relative to the earth and movable sections resiliently permitting movement of rearwardly adjacent earth substantially perpendicularly to the plane of the facing whereby earth pressure on those elements is reduced by establishment of arching forces between said rigidly held sections.

According to a still further aspect of the invention we provide a method of constructing an earthwork in which earth-pressure bearing sections of a facing are mounted rigidly relative to the earth, said facing including movable sections resiliently permitting movement of rearwardly adjacent earth substantially perpendicularly to the plane of the facing whereby earth pressure on those elements is reduced by establishment of arching forces between said rigidly held sections.

The surface elements permitting earth movement may be relatively rigid elements resiliently mounted to permit movement of the whole element or may be deformable elements such as membranes or compressable pads wherein only a part of the element moves. The reduction in earth pressure on the above elements is relative to that pressure which would be exerted if the elements were not capable of permitting earth movement.

In principle, the rigidly held sections of the facing may be held in position by any suitable means. Thus, for example, the facing may be a gravity wall in which the rigidly held parts of the facing are maintained rigidly in contact with the earth by their weight and stiffness and thus carry the earth pressure using the arching phenomenon, while intermediate thinner sections are moveable relative to the earth. However, the present invention is principally of interest in relation to stabilised earthworks, that is earthworks in which stabilising members are embedded and provide a regular array of points to which a facing can be attached and the invention is largely described herein in relation to such stabilising systems.

Thus, in general, the rigidly held sections of the facing will carry means for attachment to stabilising members embedded in the earthworks.

The stabilising elements to which the facing is attached may include reinforcing strips as described in British Patent Nos. 1563317 and 1324686 or grids or other elements embedded in layers in the earth, for example using the Reinforced Earth technique described in said British patents; other stabilising elements include tie-rods attached to anchors or "deadmen" embedded in the earth at the rear of the structure, as well as soil nails driven into existing earth masses (including rock masses).

The stabilising elements will advantageously be in the form of elongate, galvanised steel strips (e.g. having a rectangular cross-section 5mm thick by 40 mm wide) with their larger faces lying horizontally in the earth. In some cases, the reinforcing strips may each be provided with a ground anchor, e.g. a vertical plate, at their ends remote from the facing, and while this assists anchorage of the strip, the earth in the region of the facing will still be stabilised by the frictional forces between soil particles and the strip itself. The strips may be provided on their upper and lower faces with transverse ridges to assist frictional interaction with the earth. The stabilising elements may alternatively take the form of a metal mesh or plastic net or the like. A further possibility is that a single stabilising element extending rearwardly from the facing may be connected to a pair of further stabilising elements which extend rearwardly and diverge from each other.

The connection between each stabilising element and the facing may be arranged to permit relative vertical movement between the stabilised earth in which the stabilising element is embedded and the facing element to which the stabilising element is connected. Such a connection may for example comprise a pair of horizontally spaced joints allowing pivotal movement in a vertical plane.

In general it is preferred that a significant area of the rearward side of the facing in the vicinity of the points of attachment to the stabilising member should be exposed to the direct pressure of the earth. The resistance to earth movement created by the rigid attachment to the stabilising members establishes the required arching phenomenon and permits a measure of resilient movement of the earth to take place in the vicinity of the moveable or deformable surface elements without failure of the structure. In general, it is preferred that the ratio of the non-movable area of the facing to the movable area should be in the range 5:1 to 1:2, more preferably 2:1 to 1:1.

The forward movement of earth in contact with the movable sections of the facing will generally be in the range 1–4 cm, e.g. 2–3 cm, depending on the distance from the rigidly fixed points of attachment to the stabilising members. In general, the distance of such forward movement may be 0.5% to 2% of the distance between the points of attachment in the vicinity of the movable section.

The invention may be applied to a wide variety of facing systems and the following systems are illustrative.

1. A continuous relatively thin concrete facing with points of attachment to arrays of stabilising elements embedded in the earth mass, pads of resilient material such as foam rubber or expanded polystyrene being positioned in areas between said points of attachment. Such a continuous wall, for example constructed from reinforced concrete, is suitable where little or no settlement of the structure is anticipated and/or for low walls. The areas of facing covered by the resilient pads may be significantly thinner in cross section than the areas in the vicinity of the points of attachment, thus reducing the overall cost of the facing.

2. A system of interlocking facing units, for example relatively thin panels of reinforced concrete, the units being sufficiently spaced apart, usually by resilient bearing material, to permit flexibility in the plane of the facing, such units carrying a rearward panel of flexible material attached to the central area while the outer area, which also carries the means of attachment of the stabilising members, is in direct contact with the earth. Again, the areas covered by the flexible material may be thinner, thus reducing costs.

3. A system of interlocking frames, for example of reinforced concrete, secured to the ends of stabilising members, the remaining areas of the facing being capable of movement substantially perpendicular to the plane of the facing and being resiliently mounted on said frames, the frames being spaced apart sufficently to permit flexibility in the plane of the facing.

4. A system of beams (or lines of beams arranged end to end) attached to the ends of stabilising members, the substantially linear areas of the facing between such beams being capable of movement substantially perpendicularly to the plane of the facing. Such beams may be continuous or may be constructed of units and they may run vertically or horizontally or, indeed, at other appropriate angles.

5. A facing system comprising areas of facing rigidly secured to the ends of stabilising members separated on all sides by areas of facing which are capable of movement substantially perpendicularly to the plane of the facing.

In order to optimise the establishment of arching within the soil mass, it is advantageous for the rearward surfaces of those sections of the facing rigidly secured by attachment to stabilising members to be substantially perpendicular to the direction of the arching forces generated in the earth at their origin on the facing surface. These surfaces are thus preferably at angle between 30° to 60° to the plane of the facing, more preferably 40° to 50° . Thus, in the case of a beam secured to the ends of a line of reinforcing elements, the cross-section of the beam is preferably substantially triangular, (the stabilising members being attached at the point of the triangle) to assist generation of arching forces radiating rearwards on either side of the beam. Such arching forces will combine with those from neighbouring beams to form complete arches. If the beams are parallel, the arches in the earth will form essentially linear vaults which serve to retain the rearward earth. If the beams form part of a frame system, the arches from the side frame members and from the upper and lower frame members can join to form substantially domed vaults.

Where the rigidly held facing elements attached to each of the stabilising members are completely separated by moveable areas, these facing elements advantageously have angled rearward surfaces generating arches towards each of the adjacent rigidly held facing elements. In an array of stabilising members the ends of which form an essentially rectangular pattern, the facing elements will have four such angled surfaces and will be shaped essentially as four-sided pyramids attached via the point of the pyramid to the stabilising members.

The angled surfaces may advantageously be provided with grooves or other textural features which enhance frictional interaction between the surface and the earth and thus optimise the transmission of the required compressive arching forces.

The present invention is particularly beneficial in the case of a framework facing system as described in (3) above. Such frame systems are now described in greater detail.

The permitted movement of the frames in the plane of the facing should be sufficient to accommodate those movements of the earth structure which are found in practice. In general the movement of each frame in any direction in the plane of the facing, particularly the vertical direction is preferably at least 0.25%, more preferably at least 0.5%, most preferably at least 1.0% of the dimension of the frame in that direction. In general the movement of each frame will be less than 3%, more usually less than 2% of the dimension of the frame in that direction.

In general, greater vertical spacing of the frames will be required where substantial vertical movement of the earth fill is expected after compaction for example when the fill is relatively lightly compacted during construction or where the earth structure is relatively high. Lateral movement of the frames needs to be accommodated to allow for the possibility of different vertical movements of the fill at points along the facing thus requiring the frames to tilt slightly in the plane of the facing.

In a preferred form of frame structure the corners of the polygonal frames are adapted to engage via securing means permitting relative movement of said corners. Thus, for example, the securing means may comprise pins or lugs adapted to cooperate with holes or slots in the opposed corners of vertically adjacent frames, suitable resilient bearing means being provided to ensure the required movement of the frames in the plane of the facing. Such securing means may also, for example, comprise 'nails' each having a shank carrying resilient bearing means which engage with shaped surfaces at the corners of the frames to permit the required movement in the plane of the facing, and preferably a head portion which engages with the front of each polygonal frame to prevent forward movement perpendicular to the plane of the facing.

Thus for example, the frames may be provided at their corners with channels perpendicular to the plane of the frame which cooperate with the resilient bearing and the securing means.

In the case of rectangular frames, the facing may advantageously comprise spaced frames arranged to abut only at their corners, as in the arrangement of the black squares of a chess board. Thus, the frames in each horizontal row may be spaced laterally by about one frame width and the frames of the vertically adjacent rows will join the corners of said spaced frames. In this way, there will only be two frames abutting at each point of contact and the securing means will advantageously include resilient bearing means positioned between two L-shaped channels, each channel being provided by a respective frame. The resilient bearing means may be a rubber material preferably formed with external grooves to increase flexibility and facilitate relative movement of the polygonal frames. The corners of the frames may advantageously be provided with locating means such as the above mentioned pins or lugs which cooperate with the corners of vertically adjacent frames to permit limited lateral movement while assisting in locating the frames in their correct positions during assembly. Each lug may be in the form of a projecting end portion of a member embedded in the frame body, for example a concrete reinforcing bar.

Nail securing means are advantageously provided with means for attachment to the ends of stabilising elements, for example a suitably placed hole through an extended portion of the shank. However, it is also possible for the frames to be attached to stabilising elements directly, via lugs projecting rearwardly therefrom and having a hole for a bolt connection to the stabilising element. Such lugs may conveniently be extensions of the metal bearing surfaces at the corners of the frames.

The frames are advantageously constructed from uniform members comprising the sides of the polygonal shape required. This provides the advantage of simplicity of production and transport. The frames will normally be each constructed prior to assembly, for example by bolting to shaped metal brackets which, in a preferred form, may also serve as the shaped surfaces, e.g. channels, which abut the flexible bearing surfaces. Alternatively the frames may be assembled in situ from the side members and if so it may be desirable temporarily to stiffen each frame during construction by using a bar extending between diagonally opposite corners.

In an alternative embodiment, the polygonal frames may be provided at their corners with diagonal bearing surfaces which, when the framework is assembled, are separated by resilient bearing means. In this case, the diagonal bearing surface may be a metal plate serving also as securing means in the assembly of the frame, for example by cooperation with bolts protruding from the separate side members of the frame. One or both of the diagonal plates may conveniently be provided with means for attachment to the earthwork, for example a short linkage so shaped as to permit one end to be bolted to the diagonal plate while the other end is bolted to the substantially horizontal end of a stabilising element in the earth. In such an embodiment, it may be convenient to provide at each pair of bearing surfaces a pin cooperating with holes in the respective frames to prevent relative movement of the frames perpendicular to the plane of the facing. However, this is not essential, for example where both of the diagonal plates are secured to stabilising elements or to each other.

It is desirable to provide means whereby, during construction, the frames cannot overturn in the forward direction. This is conveniently achieved by extending the metal plates providing bearing surfaces at the corners of the frames sufficiently far rearwards to permit a bolt to join the two abutting plates and thus prevent their separation at that point. Alternatively, a strong substantially rectangular ring member, e.g. of steel, may be slid over the said extended metal plates to prevent such separation while not hindering the required vertical movement of the frames. It is also desirable to provide means for keeping the horizontal front surfaces of such plates apart to prevent rotation of the upper frame due to compression of the resilient bearing material, for example a bolt which can subsequently be removed. Tilting of an upper frame may also be prevented by using an elongate device which hooks on to an appropriately adapted portion at the front of the metal plates and which extends vertically to engage both a lower frame and the upper frame.

The side members of the frames are desirably of sufficient depth in the direction perpendicular to the plane of the facing to provide adequate strength and stability. In the case of concrete frames, the side members may, for example have a thickness of 100–200 mm, e.g. 130mm, a length of 1000 to 1500 mm, e.g. 1350 mm, and a width of 200–300 mm e.g. 240 mm.

The movable resilient sections of such frame structures, may be constructed from flexible, resilient material of adequate strength to resist soil pressure, for example a plastic or metal mesh secured at the edges to the frame but allowing soil movements of at least one or two cm at the center for a 1.5 metre frame. Alternatively, solid or other panels which are relatively rigid may be mounted on the frames in such a way as to permit relative movement perpendicular to the facing. If necessary, a flexible bearing can be interposed between the cover and the frame to permit such movement while maintaining a firm connection. This flexible bearing may be made from flexible material such as rubber or may be a form of spring which allows forward movement e.g. a cylindrical pipe or a U-shaped section of metal which can compress. Alternatively, the required resilient movement may be provided by deformability of the connection between the cover and the frame which connection can comprise lateral, resilient projections, for example relatively thin shaped metal bars, e.g. the elements of metal grids, which fit into slots at the rear of the frames and deform under the action of the earth pressure, thus, permitting the cover to move in the frame. The movable section is conveniently mounted on the soil side of the frame but may be mounted inside the frame or even at the front. The moveable elements should not themselves be so closely spaced at any point that they interfere with the free movement of the individual frames.

In general, the moveable sections should be free to move 1–3, e.g. 2 cm in the perpendicular direction i.e. about 0.5% to 2% of the length of each side of the frame.

The facing may be vertical with a generally flat or alternatively a curved or angled profile in plan view. In each case the shapes of the various facing components will be appropriately designed. In one alternative embodiment, a frame facing of the structure might be at an angle to the vertical, for example about 30°, with joints between adjacent frames extending generally horizontally. There will be a significant tendency for the facing frames in such a stucture to tilt rearwardly before they have been backfilled, and this may be prevented by bolting together the brackets of the frames in adjacent rows at the front of the facing, in addition to the previously described bolted connections at the rear. The stabilising elements in such a structure will also extend generally horizontally.

The stabilising elements for frame structures are largely described herein as being connected to the facing at the joints between facing frames. However, the stabilising elements may instead be secured to the side members at points away from the joints. For example, a square facing frame may have two stabilising elements secured to each side member respectively one third and two thirds of the distance along its length, the frame thus having altogether eight stabilising elements extending therefrom. The stabilising elements may be secured to plates cast into and projecting from reinforced concrete side members.

Similarly, where the rigidly fixed part of the structure comprises beams connected essentially linearly, the points of attachment of stabilising members may be at or near the ends of the beams or at intermediate points.

Apart from rectangular or triangular facing frames, other shapes may be provided, such as parallelograms. One possible frame is in the form of a parallelogram with sides at 60° to the horizontal and with the lateral spacing between the joints being equal to the height of the frame, so that the vertical side members, so as to permit some forward deflection of the mesh cover before firmly anchoring the elements 10.

Similarly, in the case of facing structures in which the rigidly fixed members are essentially linear beams, these may be arranged in straight lines, for example as vertical pillars, or may be arranged in a zig-zag or other non-linear configuration. The design of the resilently moveble sections in facing systems of the invention has been described, for convenience, largely in terms of framework facing structures, which are, indeed, preferred. It will be appreciated that similar consideration apply to the design of moveable sections for use with rigidly held beams or plates.

The following calculations demonstrate the arching effect in relation to an earth retaining wall comprising vertical pillars spaced at 2m intervals and supporting a thinner facing of either concrete or an elastic membrane. The deformation of the thinner intermediate section at varying distances from the pillar is calculated when a pressure of 20 kPa is exerted on the earth behind the wall. Young's modulus of the earth (E earth) is taken to be 50,000 kPa and Poissons coefficient for the earth is taken to be 0.3.

MODEL 1

The intermediate facing is concrete (Young's modulus =E concrete=107 kPa). The vertical pillars are of 20 cm×20 cm square cross section. Four thicknesses of concrete facing, e, are considered, namely Om, 0.0125m, 0.025m and 0.0375m. These correspond the following values of E×S (where S is the surface area of one vertical meter of facing over the half distance between pillars): OkN/ml, 125,000 kN/ml, 250,000 kN/m and 375,000 kN/ml.

FIG. 39 shows the deformation of the facing for the various values of e and FIG. 40 shows the pressure exerted by the earth on the concrete taking into account the deformation of the concrete facing as shown in FIG. 39. It can be seen that the flexural rigidity of the concrete facing permits the transmission of the forces exerted by the pillars to an significant area of earth adjacent to the pillar, in contrast with the situation where an elastic membrane is used as can be seen hereinafter.

MODEL 2

In this system, the concrete facing is replaced by an elastic membrane having a stiffness per linear meter=K of OkN/ml, 125,000 kN/ml, 250 kN/ml and 375 kN/ml, i.e. corresponding to the values of ES in Model 1. In a first calculation, the pillars are 20 cm±20cm in cross section. FIG. 41 shows the deformation of the facing at varying distances from the pillars and FIG. 42 shows the distribution of earth pressure exerted on the membrane. It can be seen that there is little significant pressure or the elastic facing at distances greater than 0.1m from the pillar; the initial 0.1m is the surface presented by the pillar itself and the increasingly large value for the pressure over that area is due to arching of compressive forces immediately behind the pillar. This contrasts with the effect shown in FIG. 39, where there was significant pressure on the facing even at 0.4m from the pillar.

On the other hand, the deformation of the elastic facing as shown in FIG. 41 is not markedly greater than when an essentially rigid concrete facing is used and consequently such an elastic membrane can readily serve to retain the earth between the pillars. Such deformation is still further reduced if the thickness of the pillars is increased slightly.

BRIEF DESCRIPTION OF THE DRAWINGS

Some preferred embodiments of the invention will now be described by way of example and with reference to the accompanying drawings, in which:

FIGS. 9 and 10 are sectional views of alternative covers for the facing frame;

FIG. 15 is a cross-sectional view through another embodiment of flexible connection between facing frames, parallel to the plane of the facing;

FIG. 16 is a cross-sectional view through a still further embodiment of a flexible connection between facing frames parallel to the plane of the facing using an elongate lug locating means;

FIG. 17 is a perspective view of a section through a further embodiment of a flexible connection using a pin locating means;

FIG. 18 is a perspective view of a frame constructed from side members which are narrower at the rear than at the front;

FIG. 19 is a front view of an array of the frames of FIG. 18;

FIG. 20 is a horizontal section through a frame as shown in FIG. 18 and includes a resiliently mounted cover;

FIG. 21 is a perspective view of a channel member for use with a frame as in FIG. 18;

FIG. 22 is a section through abutting corners of frames carrying the channel members of FIG. 21;

FIG. 23 is a section through two abutting channel members of FIG. 21 along the line A—A;

FIG. 24 is a section through two abutting channel members of FIG. 21 along the line B—B;

FIG. 25 is a cross-section new of a side member of a frame according to the invention together with part of an associated resiliently mounted cover;

FIG. 31 is a perspective view of attachment means for a stabilising element at the rear of the flexible joint, shown in FIG. 26;

FIG. 32 is a perspective view of a device for temporarily stabilising the facing frames of FIGS. 26 to 31 during construction;

FIG. 33 is a partial cross-sectional view of the stabilising device of FIG. 32 in use during construction;

FIG. 34 is a perspective view of another form of flexible connection;

FIG. 35 is a section through the connection of FIG. 34 parallel to the plane of the facing;

DETAILED DESCRIPTION OF THE PREFERRED EMBODIMENTS

Figure 1:
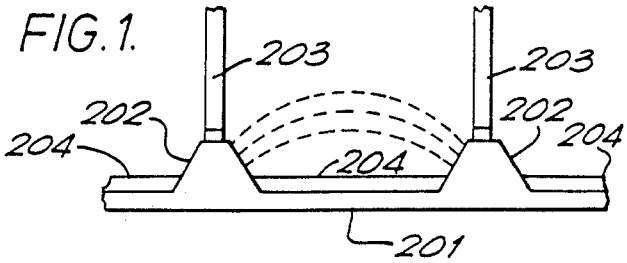
FIG. 1 is a horizontal section of a facing according to the invention provided with resilient pad sections.

In the embodiment shown in FIG. 1, a facing panel 201 is provided with strengthened portions 202 having angled edges which serve to promote arching of compressive forces. Stabilising elements 203 embedded in the earth in regularly spaced horizontal arrays are attached to the rearward sections of the strengthened portions 202. Expanded polystyrene 204 is attached on the rear side of the panel to provide the required resilience. The sections covered by the polystyrene may be significantly thinner and incorporate less steel than corresponding areas of a conventional facing panel. The strengthened portions 202 may take the form of four-sided pyramids each attached to a separate stabilising element or of 2-sided linear beams each attached to more than one stabilising element; such beams may link with other such beams to form polygonal frames. The dotted lines indicate schematically the lines of arching compressive forces.

Figure 2:
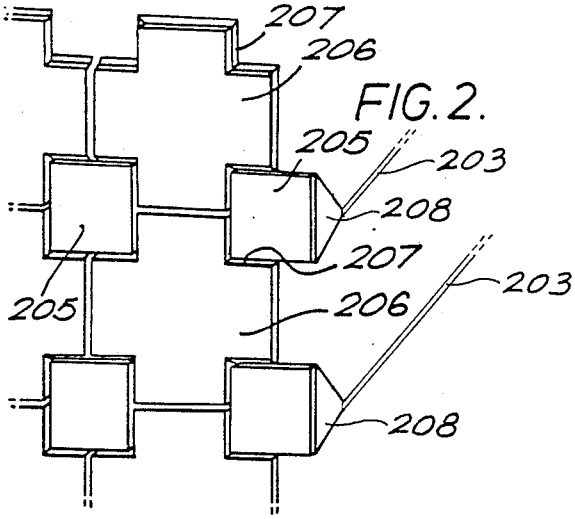
FIG. 2 is a perspective view of a facing acording to the invention in which rigidly fixed elements are separated by moveable panels.

In the embodiment shown in FIG. 2, strengthened earth retaining portions substantially in the form of four-sided pyramids 205 are secured to stabilising members 203 embedded in the earth. Cruciform thin concrete panels 206 are mounted in interlocking relationship with the four-sided pyramids 205 and with each other, being restrained from forward movement by resilient engagement between the angled corners 207 of the panels 206 and the angled surfaces 208 of the pyramidol retaining portions, a resilient pad (not shown) being situated between the said angled surfaces 207 and 208 to permit resilient forward movement of the panels 206 relative to the four-sided pyramids 205.

Figure 3:
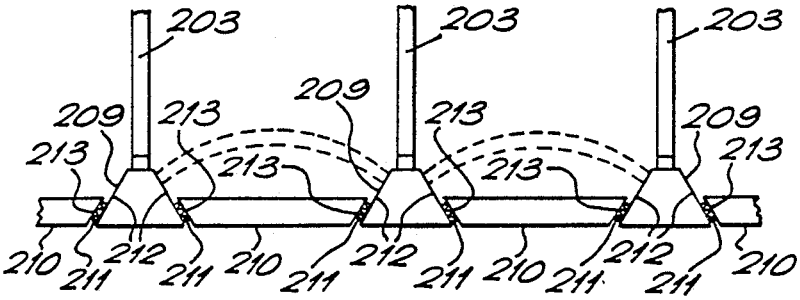
FIG. 3 is a horizontal section of a facing according to the invention in which vertical beams are separated by resilient moveable cover sections.

In the embodiment shown in horizontal cross-section in FIG. 3, vertical earth retaining pillars 209 are secured to stabilising elements 203 embedded in the earth. Relatively thin unreinforced concrete panels 210 are mounted between the pillars 209 and resilient pads 211 are inserted between the angled surfaces 212 of the beams and the angled edges 213 of the panels 210 to permit resilient forward movement of the panels 210. The vertical pillars 209 may be continuous over the height of the wall or a series of relatively short beams may rest one on the other, preferably separated by resilient pads similar to the pads 211. Similarly, the panels 210 may be continuous vertical concrete 'planks' or may be shorter panels stacked vertically and also advantageously separated by resilient pads. The dotted lines indicate schematically the lines of arching compressive forces.

Figure 4:
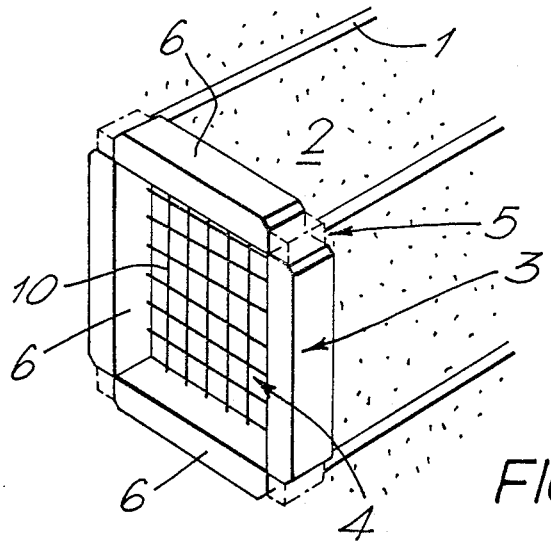
FIG. 4 is a schematic perspective view of part of a structure according to the invention.
Figure 4A:
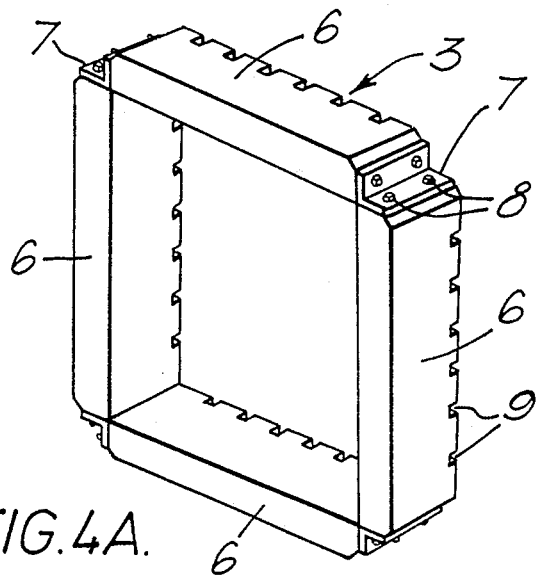
FIG. 4*a* is a perspective view of a facing frame of the structure.
Figure 5:
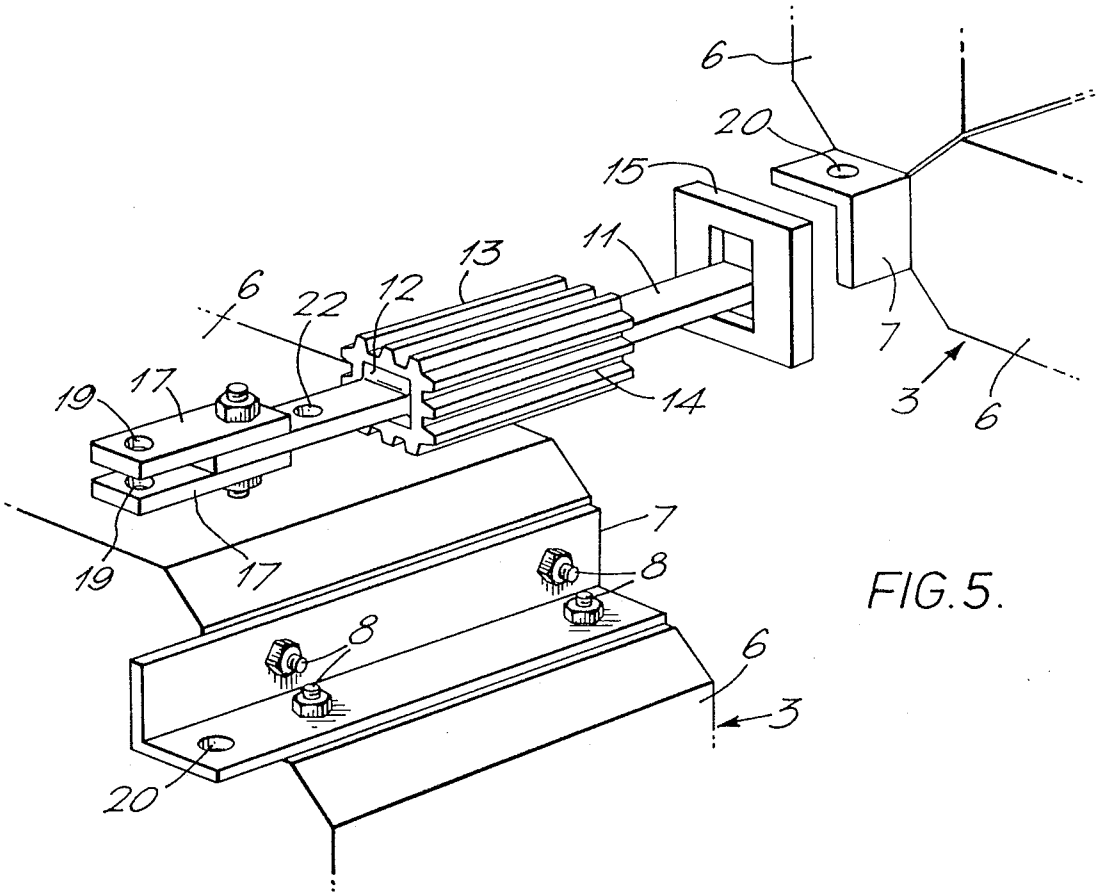
FIG. 5 is an exploded perspective view of the corners of a pair of facing frames and the securing means for flexibly connecting the frames.
Figure 5A:
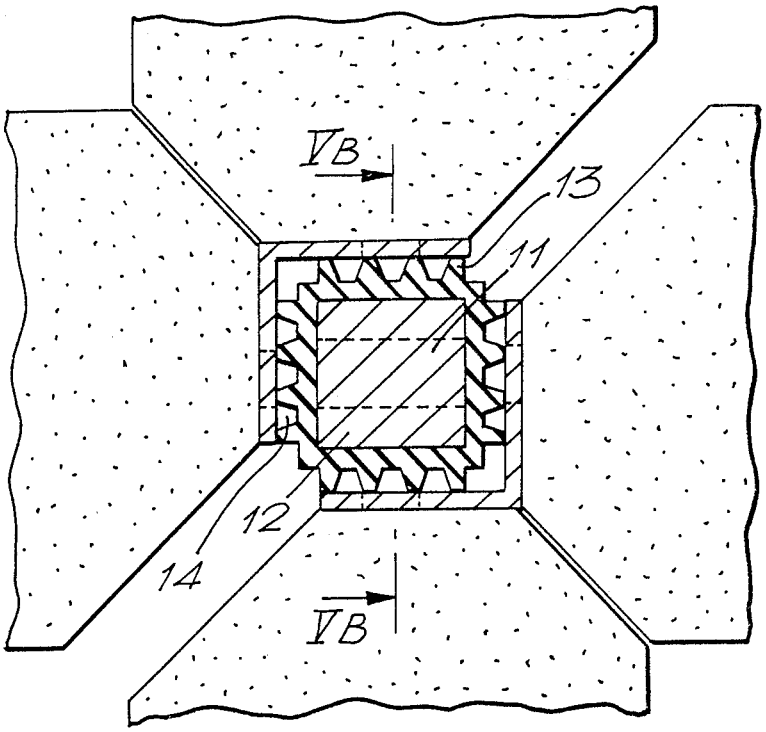
FIG. 5A is a cross-sectional view through the flexible connection of FIG. 5 parallel to the plane of the facing.
Figure 5B:
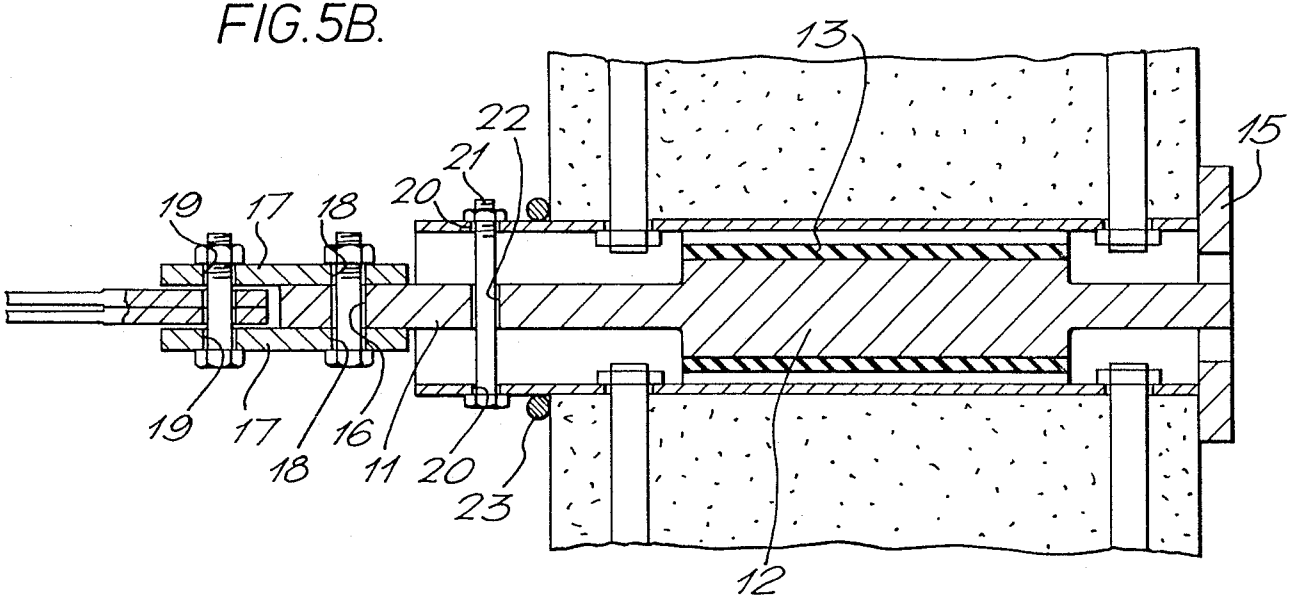
FIG. 5B is a cross-sectional view through the flexible connection perpendicular to the facing, on the lines VB—VB of FIG. 5.
Figure 6:
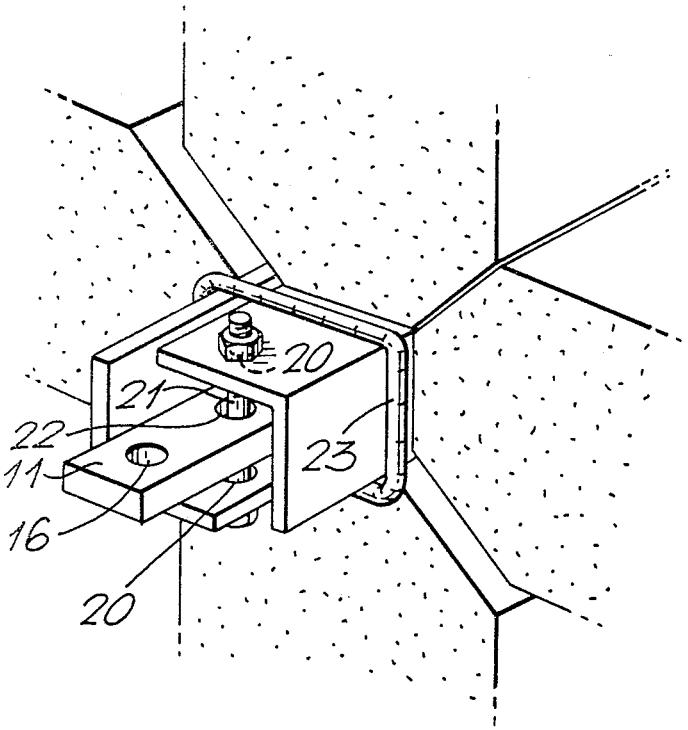
FIG. 6 is a perspective view of the flexible connection at the rear of the facing frames.
Figure 11:
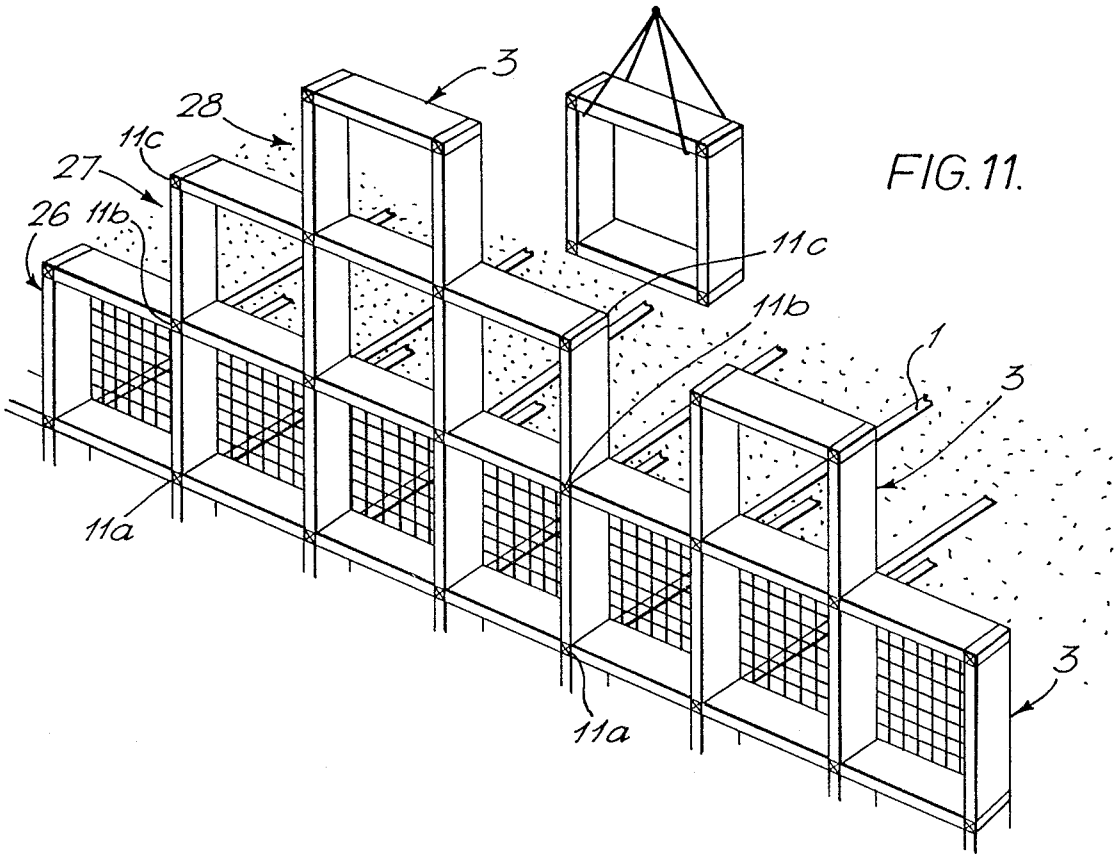
FIG. 11 is a perspective view of the structure during construction.

Referring to FIG. 4, the structure comprises elongate stabilising elements 1 embedded in soil backfill 2, facing frames 3 each covered by a mesh cover 4, and joints 5 which connect each frame at its corners to respective stabilising elements and which flexibly connect together the frames in an array, as seen in FIG. 11. From FIG. 4A it will be seen that each facing frame 3 comprises four identical side members 6, preferably of reinforced concrete, which are connected at their ends by L-section brackets 7, preferably of steel. The brackets 7 are secured to the side members 6 by bolts 8 cast into the concrete. Each side member 6 is formed at its rear surface with a plurality of spaced grooves 9 each for receiving a respective element 10 of the mesh cover 4. A number of such 35 side members may be conveniently cast in a single box in which are located spaced separators each formed with a row of projections for forming the grooves 9. More conveniently, the identical side members may be cast in an automatic press.

FIGS. 5, 5A, 5B and 6 show the joint 5 in greater detail. The joint includes a steel nail 11 having a thickened shank portion 12 of generally square section around which a rubber sleeve 13 extends, the sleeve being formed with longitudinal grooves 14. At the front end of the nail 11 a head portion 15 is welded for engagement with the front face of the facing frames, while at its rear end the nail is formed with a vertical hole 16 enabling it to be bolted to a pair of vertically spaced plates 17 each having a corresponding hole 18. Each plate 17 is formed with a further hole 19 for bolting to the plates a reinforcement 1 (or in the case of FIG. 5B, a pair of stabilising elements. Each L-section bracket 7 extends rearwardly of the facing frame 3 and is formed with an aperture 20 in its horizontal portion, the brackets 7 being connected at each joint 5 by a bolt 21 extending through the apertures 20 and through an opening 22 formed in the nail 11. The bolt 21, along with a steel tie 23 extending round the rearwardly projecting portions of the brackets 7, serve to secure together the two facing frames 3 which meet at the joint, while permitting relative vertical movement of the frames in the plane of the facing. The rubber sleeve 13 is sufficiently flexible to allow such movement, the grooves 14 contributing to the flexibility.

Figure 7:
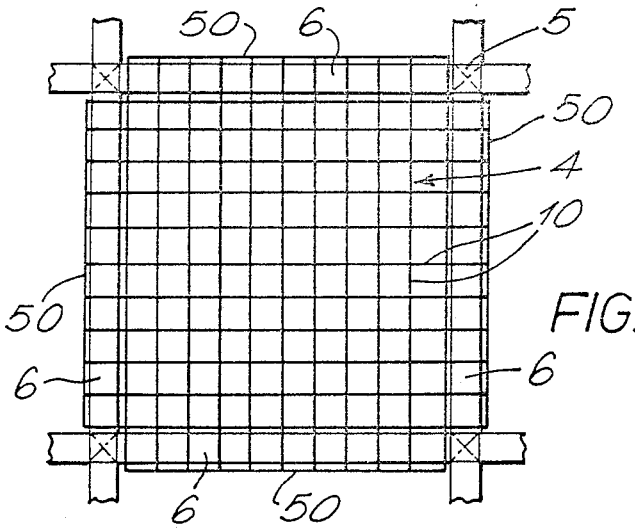
FIG. 7 is a rear elevational of a facing frame on which a cover in the form of a grid is mounted.
Figure 8:
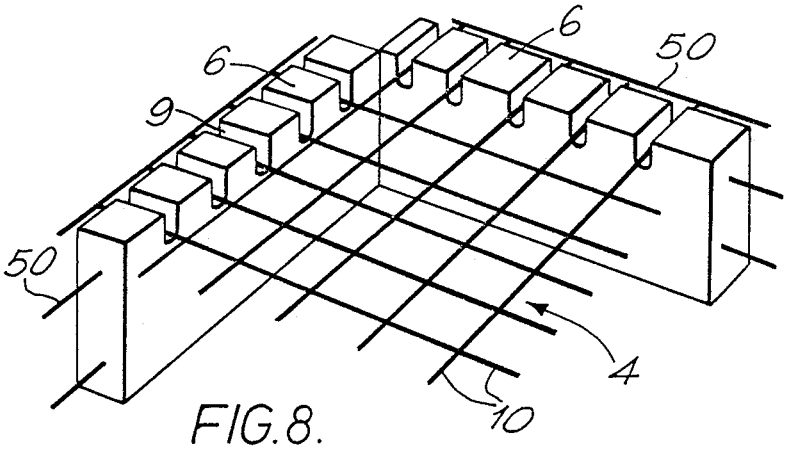
FIG. 8 is a cut away perspective view of part of the cover grid mounted on the facing frame.

FIGS. 7 and 8 illustrate a resilient section in the form of a mesh cover 4 attached to each facing frame. The spaced grooves 9 each receive a respective element 10 of the mesh cover which is sufficiently flexible to deflect or bow forwardly under soil pressure, while being sufficiently strong to withstand such pressure without risk of collapse. A peripheral mesh element 50 is disposed outwardly of each side member perpendicular to the grooves 9 so as to restrain the mesh elements 10 passing through the grooves against tension generated by soil pressures. The peripheral mesh elements 50 may be at an initial spacing from the side members, so as to permit some forward deflection of the mesh cover before firmly anchoring the elements 10. For example, with a mesh cover on a frame of nominal diameter 1500mm, the peripheral mesh elements may be initially about 6mm from the frame side members, and the forward deflection of the mesh cover at its centre may be about 70mm, the elements of such mesh being steel members of 8mm diameter. The grooves 9 formed in the side members of the facing frames are sufficiently deep to receive along their length two mesh cover elements 10, since when the facing frames are connected in an array each frame side member will engage with two adjacent mesh covers.

Alternative forms of resiliently moveable sections for the facing frames are shown in FIGS. 9 and 10, these being relatively rigid and arranged to move forwardly as a whole under soil pressure, rather than flexing as in the previously described embodiment. FIG. 9 shows a relatively thin, e.g. 60 mm reinforced concrete panel 55, in which the reinforcing bars 24 project outwardly at the panel edges to engage in the grooves 9 of the facing frame 3, these reinforcing bars being retained in position by peripheral elements 51 similar to those of the mesh embodiment. The connection of the reinforcing bars 24 to the frame enables the panel 55 to shift forwardly under soil pressure.

FIG. 10 shows another resiliently moveable reinforced concrete panel 25 provided at the front of the frame, rather than the rear as in the FIG. 9 embodiment. Thus the outwardly projecting reinforcing 35 bars 24 are of an increased length so as to reach the grooves 9 at the rear of the frame for their anchorage.

Various other modifications of the design of the moveable sections are envisaged. One possibility is for the concrete panel to have one edge at the front of the frame and another parallel edge at the rear, thereby creating shadow effects on the facing. Where at least the lower part of the panel is at the rear of the frame, the lower side member of the frame provides a ledge which can be used to carry vegetation e.g. in a so-called window box. Another possibility is for each panel to be made up of a plurality of smaller panels interconnected e.g. by steel wires or bars, so as to create a mosaic effect. In a further modication, each facing frame 3 is formed with recesses on the inside faces of the side members, the moveable section having corresponding outward projections arranged to engage in the recesses in such a way as to permit forward movement. The projections of the moveable section may be concrete or they may be extended portions of reinforcing bars projecting outwardly of the body of the panel In these arrangements the frames will normally be prefabricated with their moveable panels in position, prior to installation in the structure.

The construction of a preferred structure of the invention will be described with reference to FIG. 11. In the drawing, a row 26 of facing frames 3 is shown in position, each frame being spaced from the adjacent frames in the row by a distance corresponding to the frame width and resting on nails **11*a* provided at the corners of the frames 3 of the underlYing row of spaced frames. The nails 11 are provided with resilient bearing surfaces as described above and are attached to stabilising elements 1 lying on the compacted soil. A further row of nails 11*b* is positioned at the upper corners of the frames of row 26, resting on the upwardly facing L-section brackets 7 of the frames. The frames of the next row 27 are then lowered into position thus joining the spaced frames of row 26 to form a continuous framework. At the rear of the abutting frames of rows 26 and 27 the ties 23 are secured by the bolts 21 so as to form a positive connection between the corners of frames at each joint, this connection helping to prevent forward tilting of the frames in row 27. This connection prevents the rear of the frames from lifting up, and in order to prevent the front of the frames from compressing the resilient bearings to the nails 11 to an excessive extent, a pair of pinch bars may be used to hold apart the brackets 7 at the front of the facing. Then the covers for the frames of row 26 are located in position. If the facing frames 3 are of the kind prefabricated with covers, then further covers will only be needed for the new frames created i row 26 by positioning the frames of row 27 to form the spaced upper corners of the frames of row 26. The row 26 is then back-filled with compacted soil up to the level of the nails 11*b* and the latter are attached to a further layer of reinforcements 1 laid in the compacted soil. Nails 11*c* are then positioned on the frames of row 27 and frames of the next upwards row 28 lowered into position. Row 27 is then ready, after positioning of the moveable sections for backfilling with compacted soil. This procedure is repeated with addition of further sets of frames and backfilling the completed rows. Once row 28 of frames has been backfilled the stabilising elements 1 extending from the nails 11*c* between the rows 27 and 28 will be secured and stabilise the frames of row 27 against forward tilting. At this point the pinch bars at the front of the joints between rows 26 and 27** may be removed.

Figure 12:
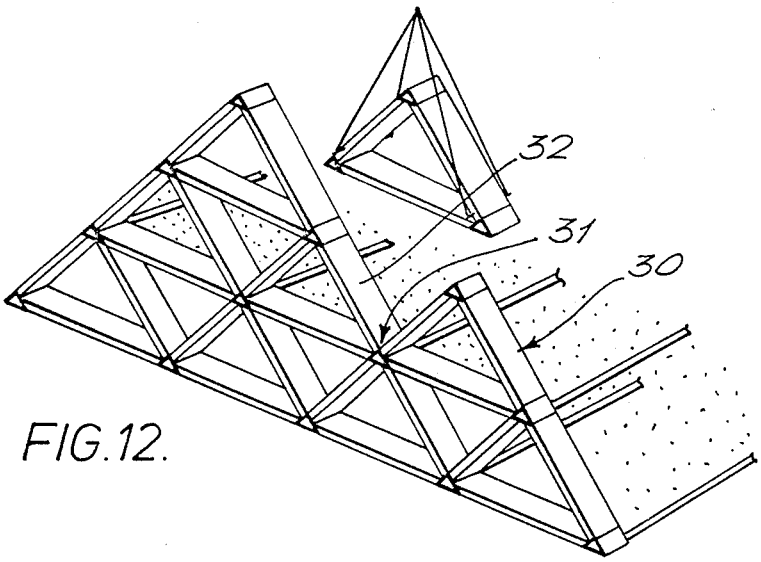
FIG. 12 is a perspective view showing construction of an embodiment having triangular facing frames.
Figure 13:
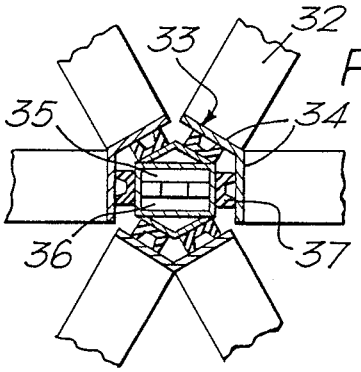
FIGS. 13 and 14 are cross-sectional views through alternative forms of connection between the frames of FIG. 12.
Figure 14:
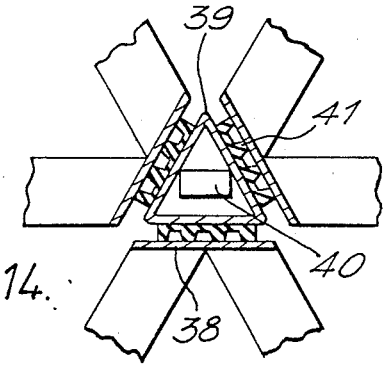

The structure shown under construction in FIG. 12 has triangular facing frames 30 so that three such frames meet at each joint 31 which may be formed as shown in FIG. 13 or FIG. 14. In the arrangement of FIG. 13, the side members 32 of the frames are secured together by being bolted to V-section brackets 33 having legs 34 at 120° to each other. A shank 35 of a nail 36 has a box-section to which are welded upper and lower V-plates to form six outer faces of the shank. On each face is provided a rubber spacer 37 against which bears a respective leg 34 of the brackets 33. The brackets have rearwardly projecting portions which, as in the square frame embodiment, may be connected together to avoid forward tilting of the frames during construction.

In the arrangement of FIG. 14, instead of using V-section brackets to connect the side members of the frames, flat plates 38 are used. The shank 39 of the nail 40 is of triangular section and on each face of the shank a rubber spacer 41 is provided. The ends of the side members are appropriately shaped for this type of connection.

FIG. 15 shows an embodiment in which the facing frames 60 are flexibly connected without the use of the nails referred to previously. In this case each frame 60 is secured at its corner by a diagonal plate 61 attached to the frame side members 62 by bolts 63 protruding from the side members. A pair of resilient spacers 64, e.g. of rubber, are disposed between the two plates to provide a flexible connection, the spacers being formed with grooves 65 running perpendicular to the plane of the facing to improve flexibility.

In the embodiment shown in FIG. 16, the lower corners of the upper frame 3C are provided with steel channel members 42 which cooperate with elongate lugs 43 provided on the upper corners of two lower frames 3A and 3B. Resilient means 44, for example rubber bearings or spring elements, are provided between the said corners to absorb vertical movement of the frames.

In the embodiment shown in FIG. 17, the abutting frames 3A and 3C are provided with L-shaped channel members 45 having bearing surfaces 46. The bearing surfaces 46 of the lower frame 3A is provided with a pin 47 which engages with a hole 48 in the bearing surface 46 of the upper frame, thereby assisting location of the frames during assembly while permitting some lateral movement. A rubber bearing 49 is provided between the surfaces 46 in order to absorb vertical forces.

In the embodiment shown in FIGS. 18, 19 and 20 the side members 6 of the frame are narrower at the rear than at the front, thus presenting angled rear surfaces 6A which assist establishment of compressive arching forces indicated by dotted lines. A cover is provided as shown in FIG. 20 which is constructed from concrete. A resilient block 120 is provided between the angled side of the cover and the angled side of the frame. The dimensions of the cover are such as to allow a forward movement of the cover of about 2 cm.

In the embodiment shown in FIGS. 21, 22, 23 and 24 the corners of the frame are provided with brackets 7 which serve to connect the side members via bolts and which further carry bearing surfaces 150 and 151 provided with resilient bearings 152 and 153. Lugs 154 and 155 are provided which cooperate like hooks to assist location of the frames during assembly while allowing some lateral movement. The brackets 7 extend rearwards and forwards of the frames and are provided with holes 156 and 157 which are adapted to engage with bolts 35 joining the abutting channel members 6 of vertically adjacent frames; this serves to hold the upper frames in the vertical position during assembly, when they are otherwise unsupported. Further holes 58 are provided which may be bolted to stabilising elements such as strips embedded in the earth.

In the embodiment shown in FIG. 25, the side member 75 of a frame is provided with slots 76. A moveable section 77 constructed from concrete cast on wire mesh 78 has side elements of the mesh 79 which engage in the slots 76 and which are so shaped as to bend under the forward movement of the cover due to earth pressure.

Figure 26:
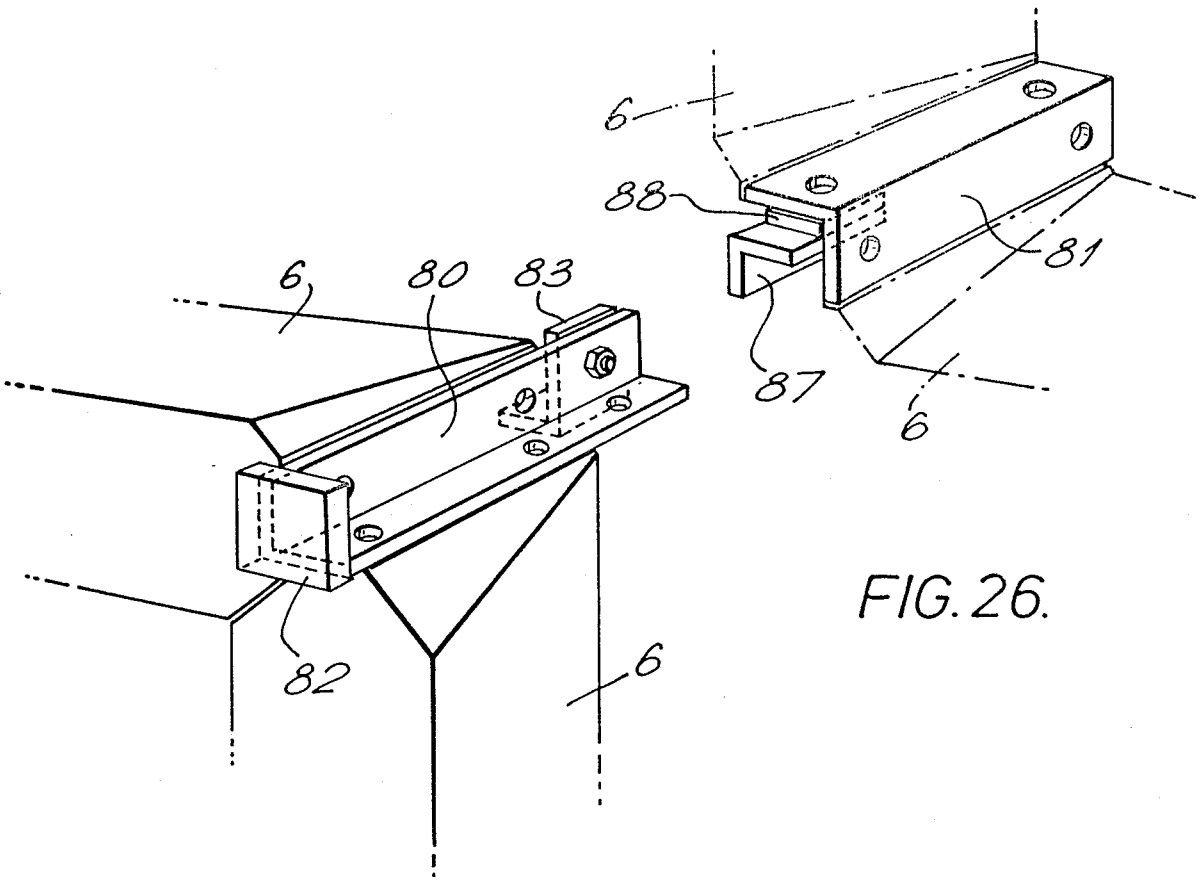
FIG. 26 is a perspective view of another form of flexible connection, with certain parts omitted for clarity.
Figure 27:
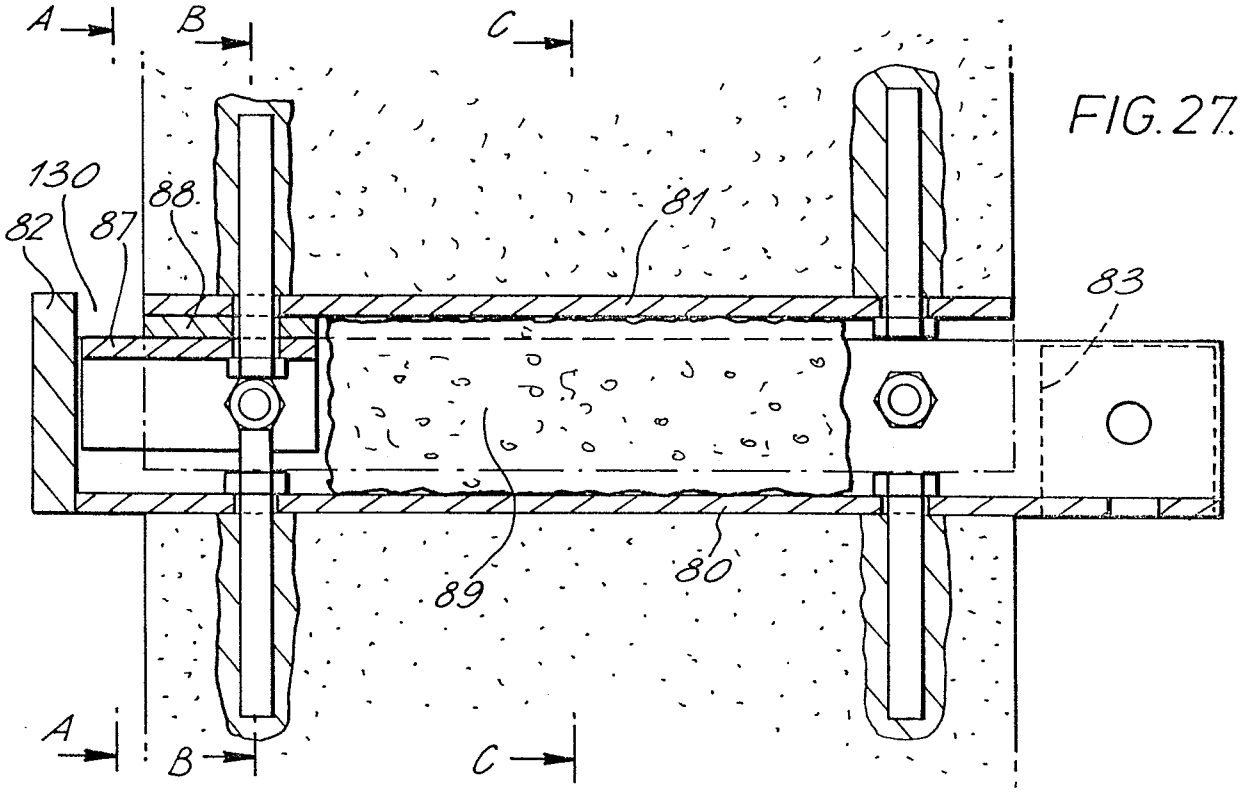
FIG. 27 is a longitudinal cross-sectional view in a vertical plane through the connection of FIG. 26.
Figure 29:
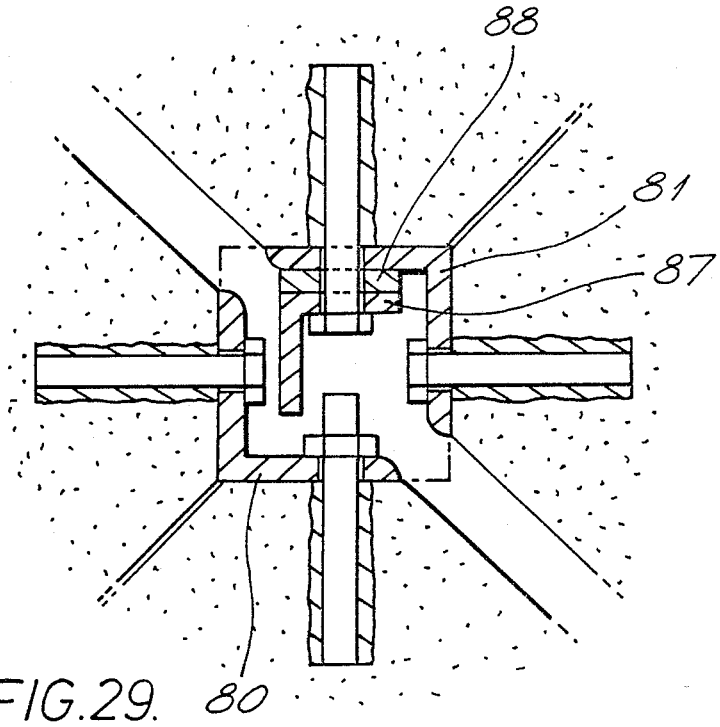
FIGS. 28, 29 and 30 respectively are cross-sectional views along the line A—A, B—B and C—C of FIG. 27.
Figure 28:
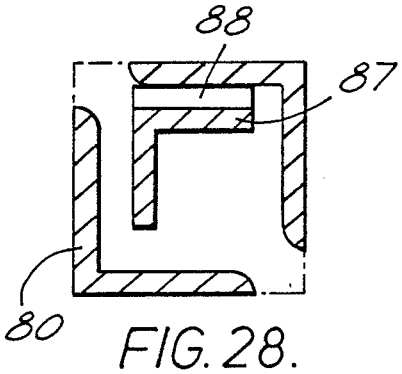

Referring to FIG. 26, this shows a pair of facing frames similar to the frame of FIg. 18 and having side members 6 narrower at the rear than at the front. The flexible connection between the frames consists of an L-section bracket 80,81 bolted to each frame, as seen in FIGS. 27 and 29. The attachment means for a stabilising element or elements at the rear of the frames includes a relatively short bracket 83 also of L-shaped cross section bolted to the rear of the lower L-section bracket 80 to form an inverted T-shaped rear projection, as seen in FIG. 31. A pair of connecting plates 84 fit above and below the cross bar of the "T" formed by the brackets. The connecting plates are formed with suitable holes for bolting to the brackets and the upper connecting plate 84 is formed with a slot 85 for receiving the vertical portions of the brackets. A hole 86 is formed through the rear part of each connecting plate to receive a bolt for connection of a stabilising element. Instead of a single hole 86 a pair of laterally spaced holes may be provided for connection of a pair of stabilising elements.

Figure 30:
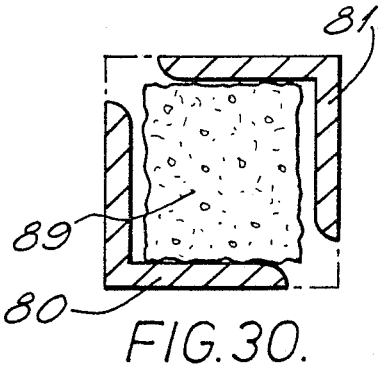

As shown in FIGS. 26 to 29, the upper bracket 81 of the upper facing frame has bolted thereto a relatively short L-section bracket 87 with a spacer plate 88 arranged between the two brackets. The bracket 87 projects forwardly so as to abut against a front plate 82 secured, e.g. by welding, to the lower bracket 80 and to define a space 130 between the front face of the upper frame and the front plate 82. As seen in FIGS. 27 and 30 a resilient block 89, e.g. of rubber, fits between the lower and upper brackets 80,81 to provide a flexible connection between the frames. The resilient block could alternatively be replaced by a C-shaped spring of steel or the like arranged to permit resilient relative movement between the frames.

Thus in the embodiment of FIGS. 26 to 31 the rear of the lower bracket 80 is secured to one or more stabilising elements embedded in the earth backfill, thereby securely locating the lower frame, while the short front bracket 87 connected to the upper bracket 81 abuts against the front plate 82 of the lower bracket 80, thereby securely locating the upper frame. By this arrangement the frames are secured to the stabilising elements and restrained against forward movement, while the resilient block 89 permits relative movement of the frames in the plane of the facing.

The purpose of the space 130 between the upper frame and the front plate 82 will be described with reference to FIGS. 32 and 33 which show a device 90 used during construction to ensure that a frame 91 of an upper row of frames does not tilt forwardly. The device 90 comprises an elongate member 92 having at its upper and lower ends abutment plates 93 arranged to engage the front of the facing in the region of the flexible connections, as seen in FIG. 33. Midway of its length the device 90 has a hook member 94 with a downwardly projecting portion 95 arranged to engage in the space 130 between the upper frame 91 and the front plate 82 of the lower bracket 80. During construction as shown in FIG. 33, the top part of the frame 91 is restrained against forward movement by the device 90 which is secured to the facing by the hook member 94. The device may be removed once the stabilising elements at the top of the frame 91 have been backfilled, thereby permanently securing the top of the frame 91.

Figure 36:
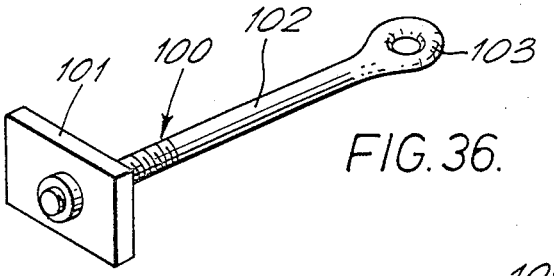
FIG. 36 is a perspective view of a nail for use in the connection of FIGS. 34 and 35.

In the arrangement shown in FIG. 34 the side members 97 of the frame 96 are each provided with a pair of U-shaped lugs 98 which can conveniently be formed as part of the conventional reinforcing bars of the side members. Adjacent side members are held together by a bar 99 which passes through the two lugs of each side member. As seen in FIG. 35 two such frames 96 are connected together at their corners with a resilient block 160 arranged therebetween to permit relative movement between the frames. The connection is completed by a nail 100, shown in FIG. 36, which has a front plate 101 for abutment against the front faces of the frame side members and a widened rear portion 103 having a vertical hole for attachment to a stabilising element. The front plate 101 should be of a size sufficient to ensure that its abutment area with these front faces is large enough to accommodate stresses caused by forwardly acting earth pressures on the frames. The shank 102 of the nail 100 is of circular cross section and is arranged to screw into a hole in the front plate 101 once the shank has been threaded through a central hole 104 in the resilient block.

The nail 100 may alternatively have a shank of uniform rectangular cross section which may be threaded through a correspondingly shaped hole in the resilient block. At the front of such a rectangular nail a front plate may be welded, so that the nail is installed by threading through 35 the staples in the direction from the front to the rear of the facing. It will thus be seen that in the arrangement of FIGS. 34 to 36 significantly less steel is used at the flexible connection between frames than in the previously described embodiment.

Figure 37:
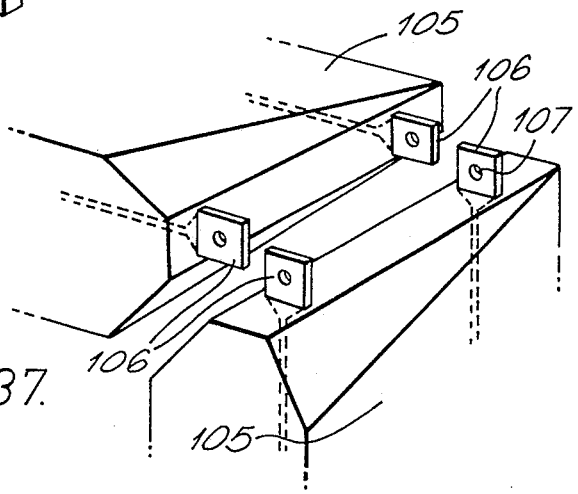
FIG. 37 is a perspective view of part of another form of flexible connection.
Figure 38:
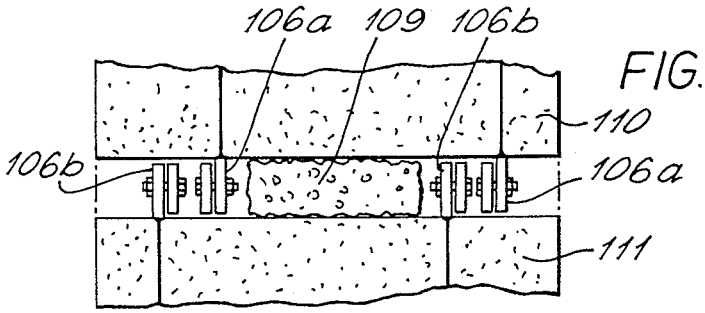
FIG. 38 is a vertical section through the connection of FIG. 37.
Figure 39:
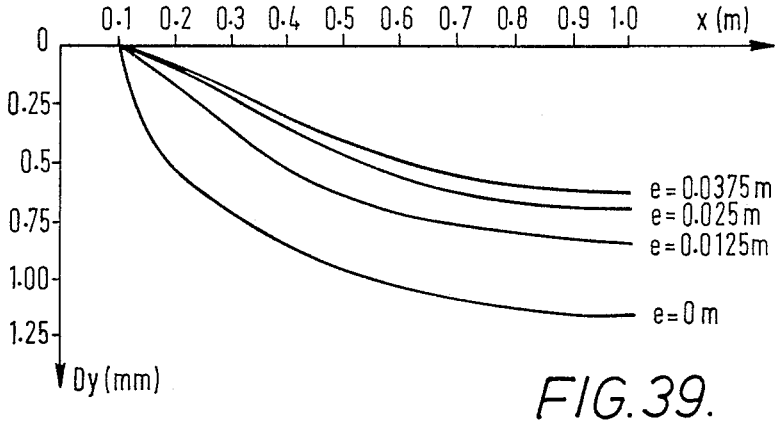
FIGS. 39–42 illustrate graphs relating to the calculations discussed above.
Figure 40:
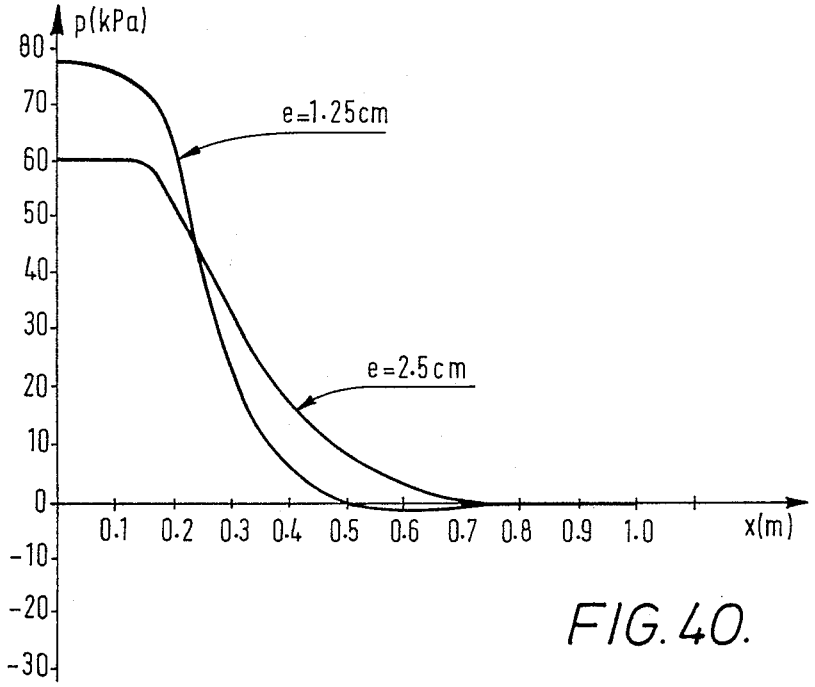
Figure 41:
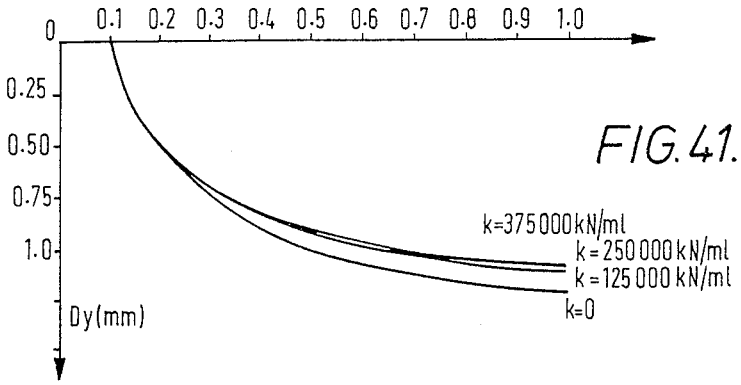
Figure 42:
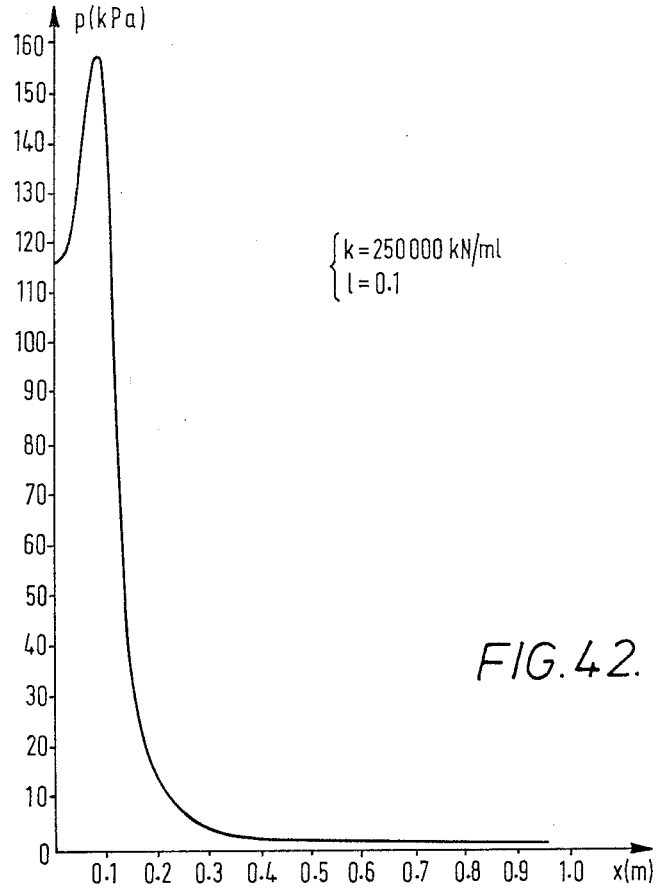

In the embodiment shown in FIGS. 37 and 38 each frame consists of four side members 105 each having at its opposite ends a pair of plate-like attachment lugs 106. These lugs, preferably of steel, are provided integrally on the ends of members embedded in the concrete side member and each lug has a hole 107 therethrough for passage of a bolt 108 for securing together adjacent side members 105 of a frame.

FIG. 38 shows how the attachment lugs 106 of upper and lower frames 110 and 111 fit together at the flexible connection with a resilient block 109 located in the space defined by the ends of the side members. The two pairs of lugs designated **106*a* secure together the side members of the upper frame 110 and the two pairs of lugs designated 106*b* secure together the side members of the lower frame 111. As seen in FIG. 38 the lugs 106*a* and 106*b*** associated with the respective frames are offset from each other along the axis of the connection so that the lugs nest together substantially coaxially. In such an arrangement the frames will normally be connected to stabilising elements at points on the side members spaced away from the flexible connections between frames, described in more detail hereinafter.

In the embodiment of FIGS. 37 and 38, each side member is formed with a pair of attachment lugs 106, but in an alternative arrangement each side member may instead be provided with a single lug. Each lug may be formed by a U-shaped bent plate having its bent portion embedded in the frame side member and its two end portions spaced apart and projecting from the side member, possibly with the space between the plates filled in with concrete to form a block-shaped lug.

What is claimed is:

1. A facing for an earthwork, said facing having front and rear sides and lying in a plane, said facing comprising: a plurality of earth pressure bearing sections rigidly positioned relative to earth disposed on the rear side of the facing, said earth pressure bearing sections being arranged to form an array of interconnected polygonal frames, and other sections that are connected to said earth pressure bearing sections so as to be enclosed by the polygonal frames in the plane of the facing, said other sections including means for permitting limited resilient movement of rearwardly adjacent earth in a direction substantially perpendicular to the plane of the facing whereby earth pressure on said other sections is reduced by establishment of arching forces between said pressure bearing sections.

2. A facing as claimed in claim 1, wherein stabilizing members are attached to the earth pressure bearing sections for being embedded in the earth to rigidly hold said earth pressure bearing sections relative to the earth.

3. A facing as claimed in claim 2, wherein the stabilising elements are reinforcing strips.

4. A facing as claimed in claim 2, wherein the stabilising elements are grids.

5. A facing as claimed in claim 2, wherein the stabilising elements are tie-rods secured to anchors.

6. A facing as claimed in claim 2, wherein the stabilising elements are soil nails.

7. A facing as claimed in claim 2, wherein each stabilizing member is attached to an individual pressure bearing section, said pressure bearing sections being separated from one another on all sides by said movable sections.

8. A facing as claimed in claim 1, wherein the pressure bearing sections include beams which are attached to at least two stabilizing members and which are separated on each side by moveable sections.

9. A facing as claimed in claim 1, wherein the pressure bearing sections have a rear side that corresponds to the rear side of the facing and a front side that corresponds to the front side of the facing, said pressure bearing sections being narrower at the rear side.

10. A facing as claimed in claim 9, wherein the moveable sections permit the earth to move approximately 2 to 4 cm in the direction perpendicular to the plane of the facing.

11. A stabilized earthwork including a facing, said facing having front and rear sides and lying in a plane, said facing comprising: a plurality of earth pressure bearing sections rigidly positioned relative to earth disposed on the rear side of the facing, said earth pressure bearing sections being arranged to form an array of interconnected polygonal frames, and other sections that are connected to the pressure bearing sections so as to be enclosed by the polygonal frames in the plane of the facing, said other sections including means for permitting limited resilient movement of rearwardly adjacent earth in a direction substantially perpendicular to the plane of the facing whereby earth pressure on said other sections is reduced by establishment of arching forces in the earth between said pressure bearing sections.

12. A method of constructing a facing for an earthwork comprising the steps of: rigidly mounting earth pressure bearing sections relative to the earth to form an array of interconnected polygonal frames, and connecting other sections to said pressure bearing sections in a manner whereby said other sections are enclosed by the polygonal frames in the plane of the facing, and in a manner that permits limited resilient movement of rearwardly adjacent earth in a direction substantially perpendicular to the plane of the facing and that reduces earth pressure on said other sections by establishment of arching forces between said pressure bearing sections.

13. An earth-pressure bearing facing unit for a stabilised earthwork comprising: a plurality of earth pressure bearing surfaces and an opposed facing surface provided on at least one rigid member, said at least one rigid member having means for attachment to at least one rearwardly extending stabilizing member embedded in the earth, said pressure bearing surfaces being spaced apart from each other and at an angle relative to said stabilizing member that is greater than 90°, and said earth-pressure bearing facing unit further comprising another member located adjacent at least one of the spaced apart pressure bearing surfaces and including means for permitting limited resilient movement of rearwardly adjacent earth in a direction substantially parallel to said stabilising member, whereby earth pressure on said other member is reduced by establishment of arching forces between said spaced apart pressure bearing surfaces.

* * * * *